US006672028B2

(12) United States Patent
Henninger

(10) Patent No.: US 6,672,028 B2
(45) Date of Patent: Jan. 6, 2004

(54) SUPPORT BEAM

(75) Inventor: Christioph Henninger, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 36 days.

(21) Appl. No.: 09/994,221

(22) Filed: Nov. 26, 2001

(65) Prior Publication Data

US 2002/0102372 A1 Aug. 1, 2002

(30) Foreign Application Priority Data

Nov. 29, 2000 (DE) ..... 100 59 281

(51) Int. Cl.[7] ..... E04C 3/30
(52) U.S. Cl. ..... 52/720.1; 52/730.6
(58) Field of Search ..... 52/730.4, 730.6, 52/720.1, 40; 118/100

(56) References Cited

U.S. PATENT DOCUMENTS 5,005,515 A * 4/1991 Sollinger ..... 118/100
5,356,519 A * 10/1994 Grabscheid et al. ..... 162/281
5,979,119 A * 11/1999 Trafton ..... 52/40
6,197,112 B1 * 3/2001 Stotz et al. ..... 118/100

FOREIGN PATENT DOCUMENTS

| | | | |
|---|---|---|---|
| DE | 41 41 133 C1 | 5/1993 | ..... D21G/3/04 |
| DE | 297 01 176.6 | 5/1997 | ..... D21H/23/32 |
| DE | 196 49 559 A1 | 6/1998 | ..... B05C/5/02 |
| DE | 197 13 195 A1 | 10/1998 | ..... F16S/3/02 |

* cited by examiner

*Primary Examiner*—Carl D. Friedman
*Assistant Examiner*—Basil Katcheves
(74) *Attorney, Agent, or Firm*—Taylor & Aust, P.C.

(57) ABSTRACT

A support beam for a long functional unit, specifically in a paper and/or coating machine, including a long hollow body having a round or polygonal cross section and manufactured from a fiber reinforced material which was produced in a winding process, whereby the invention provides that the fiber reinforced material is one having a modulus of elasticity of >100 Gpa, and a heat expansion of $\leqq 2\times10^{-6}$ 1/° K in its longitudinal direction, as well as a fiber orientation whereby a first fiber content of 70% to 90% is approximately parallel to the longitudinal direction and a remaining second fiber content is aligned in the circumferential direction.

4 Claims, 1 Drawing Sheet

SUPPORT BEAM

BACKGROUND OF THE INVENTION

1. Field of the invention

The present invention relates to a support beam for a long functional unit, and, more particularly as used in a paper and/or coating machine, having a long hollow body with a round or polygonal cross section and manufactured from a fiber reinforced material which was produced in a winding process.

2. Description of the related art

Generic support beams are already known and serve to locate and support, for example, doctor blades which are used in paper machines to keep dryer cylinder shell surfaces clean, or to remove the paper or cardboard web from the shell surface.

A support beam of this type is described in DE 41 41 133. The support beam has a fiber-reinforced material and is manufactured in the embodiment of a long hollow body, having essentially a polygonal cross section.

Support beams of this type for coating units are known from DE 196 49 559.8 or DE 297 01 176.6.

A support having fiber reinforced material CFK (carbon fiber reinforced laminate) is also cited in DE 197 13 195. This support includes a bundle of tubular support elements, whereby the individual tubes are manufactured in a winding process by utilizing heat and pressure. It is also disclosed that appropriate selection of the main fiber orientation, which should preferably progress approximately parallel to the longitudinal axis of profile element, minimizes heat expansion in the longitudinal direction and, therefore, deflection.

In the field, however, these support beams were not totally satisfactory. Particularly with the current demand for machine widths in paper and coating machinery of 8 meters or wider, the support beams are susceptible to vibration. This results in a less than perfect operation across the entire width of the functional elements that are mounted on the support beams, such as doctor blades or coating devices. What is needed in the art is a support beam that is deflection resistant and that has minimal susceptibility to vibration.

SUMMARY OF THE INVENTION

The present invention improves this type of support beam so that it is not only deflection resistant, but also substantially vibration free.

The present invention provides, by increasing the natural frequency and by aligning a certain part of the reinforcing fibers longitudinally and by aligning another part of the reinforcing fibers in circumferential direction, reduction in the vibration susceptibility by a surprisingly large amount.

The support beam according to the present invention can be utilized particularly advantageously in coating equipment, that is coaters and film presses. Specifically in units, which are marketed by the assignee under the names SpeedCoater™, SpeedSizer™ or SpeedFlow™, substantially vibration free support beams have a positive effect on the coating results on a material web.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a perspective view of a coater including a support beam according to the present invention.

The exemplification set out herein illustrates one preferred embodiment of the invention, in one form, and such exemplification is not to be construed as limiting the scope of the invention in any manner.

DETAILED DESCRIPTION OF THE INVENTION

Figure 1:
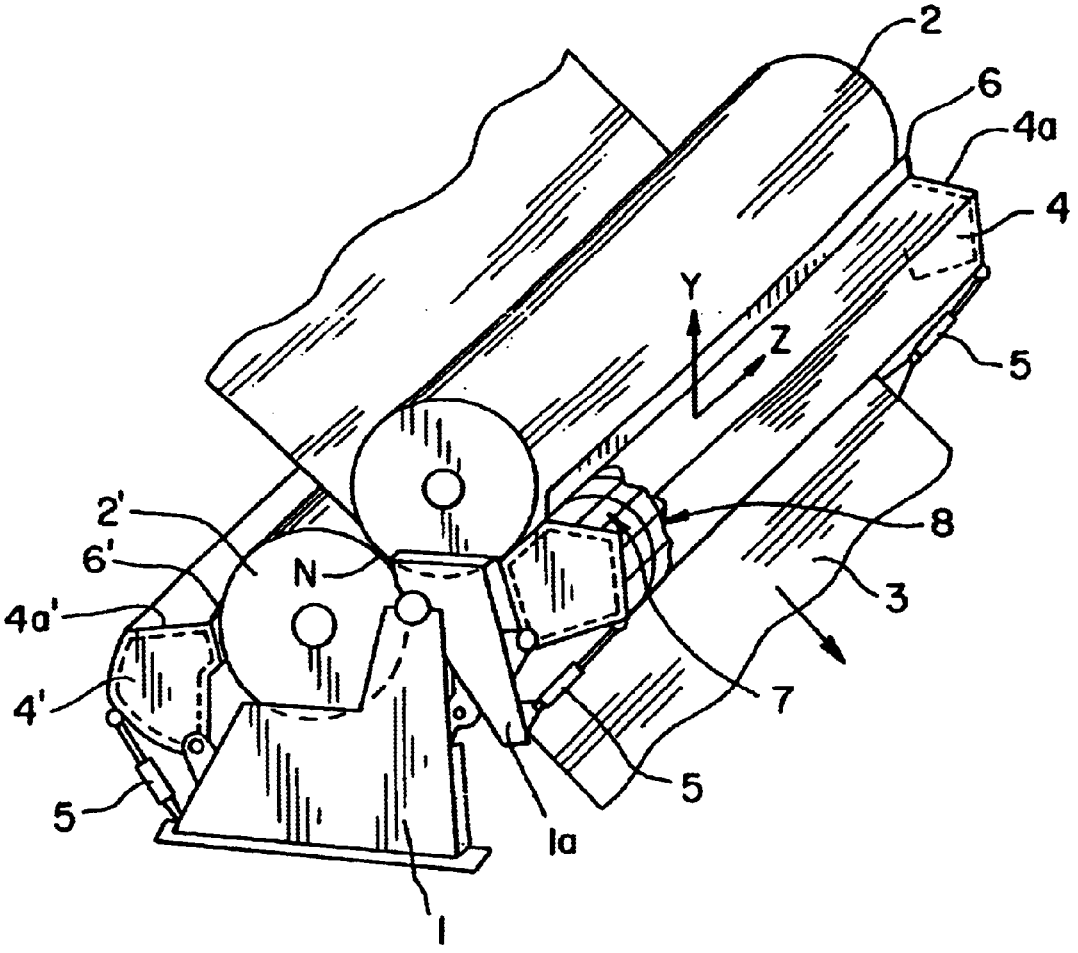

Referring now to the drawing, there is shown a coater which generally includes frame supports 1 with support levers 1*a* on the operator and drive side of the coater. The coater may be an online or offline machine.

The drawing shows only one side of the coater. Two full machine-width rotating applicator rolls 2 and 2' with their own drive are mounted in frame parts, which, for reasons of clarity are not illustrated here. Both rolls 2 and 2' are mounted so that together they form nip N through which material web 3 travels from the top toward the bottom, as indicated in the selected example by the arrow.

Each of rolls 2 or 2' has an associated support beam 4 and 4', respectively, which are also machine wide. Support beams 4 and 4' rest on the frame supports 1 by way of mounting levers 1*a*.

Hydraulic cylinders 5 permit pivoting down of support beams 4 and 4', for example, for maintenance purposes. As illustrated schematically in this embodiment function elements 6 and 6', for example doctor blades, are mounted on topside 4*a* and 4*a*', respectively, of support beams 4 and 4', respectively. In other embodiments, instead of doctor blade 6, a metering rod, a metering strip, an application unit such as a nozzle type applicator, or individual applicator nozzles are mounted along the length of support beam and the length of the associated roll.

Support beams 4 and 4' are hollow, to reduce the weigh of support beams 4 and 4', and also, so that a Coater fluid distributing pipe can be located in the hollow space, thereby saving space.

Arrows in FIG. 1 indicate directions Y and Z. Direction Z is in the longitudinal direction for support beams 4 and 4'. Normally, that is without fiber orientation according to the invention and with a modulus of elasticity of >100 Gpa, the lowest natural frequency occurs in this Z-direction.

Support beams 4 and 4' are manufactured in a winding process using fiber reinforced material wherein the fiber-reinforced material is glass fiber laminate (GFK), carbon fiber laminate (CFK) or aramide. A plurality of first fibers 7 are aligned in support beams 4 and 4' longitudinal direction and a plurality of second fibers 8 are aligned in support beams 4 and 4' circumferential direction. The fiber reinforced material has a modulus of elasticity of greater than 100 Gpa, and a thermal expansion coefficient of not greater than $2\times10^{-6}$ 1/° K in its longitudinal direction. The plurality of first fibers 7 and the plurality of second fibers 8 together define a total number of support fibers, with the plurality of first fibers 7 including about 70% to about 90% of the total number of support fibers. The plurality of first fibers 7 are within 15° from the support beam longitudinal direction. Plurality of second fibers 8 are aligned between about 75° and about 90° from the support beam longitudinal direction.

Because of the fiber alignment according to the present invention and the selected parameters, a high initial natural frequency of more than 5 Hz is achieved, as shown in Table 1, thereby minimizing the vibration susceptibility of the support beams considerably. The entire coating machine becomes dynamically more stable.

The initial natural frequency is very low and is very often in the range of the rotary frequency of the rolls.

Studies on natural frequencies on conventional steel support beams and fiber reinforced support beams are listed below. The measurements were taken at various node points of the support beam. As already noted, the initial natural frequency was the most critical, since it had a value of less than 5 Hz. By utilizing the support beam according to the invention, this initial natural frequency could be raised to 5.4 Hz.

Even the higher natural frequencies (i.e., items 3 and 4 in Table 1) were clearly increased. This means an increase in the deflection natural frequency of the machine wide support (doctor blade beam).

TABLE 1

| | Conventional Support beam | Fiber reinforced support beam according To the present invention |
|---|---|---|
| Weights: | | |
| Stands – operator side + drive side | 10 t | 10 t |
| Support lever – operator side + drive side | 2.5 t | 2.5 t |
| Roll, 1 ea. | 34.5 t | 34.5 t |
| Beam, 1 ea. | 10.5 t | 2.8 t |
| Vibration natural frequencies: | | |
| 1. Natural frequency in Z-direction | 3.8 Hz | 5.4 Hz |
| 2. Natural frequency in Z-direction | 7.3 Hz | 8.6 Hz |
| 3. Natural frequency in Z-direction | 8.6 Hz | 10.5 Hz |
| 4. Natural frequency in Y-direction | 10.8 Hz | 16.5 Hz |
| 5. Natural frequency in Y-direction | 15.7 Hz | 22.0 Hz |

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A support beam for use in one of a paper machine and coating machine, said support beam comprising:

a hollow body with a longitudinal direction, a circumferential direction and one of a round and a polygonal cross-section, aid support beam being made of a fiber reinforced material with a plurality of first fibers and a plurality of second fibers, said fiber reinforced material having a modulus of elasticity of greater than 100 Gpa, and a thermal expansion coefficient of not greater than $2\times10^{-6}$ 1/° K in its longitudinal direction, between approximately 70% to 90% of said first fibers being aligned substantial y parallel to said support beam longitudinal direction, said plurality of second fibers being substantially aligned to said circumferential direction of said hollow body.

2. The support beam of claim 1, wherein said plurality of first fibers are within 15° from said support beam longitudinal direction.

3. The support beam of claim 1, wherein said plurality of second fibers are aligned between approximately 75° to 90° from said support beam longitudinal direction.

4. The support beam of claim 1, wherein the fiber reinforced material is comprised of one of glass fiber laminate (GFK), carbon fiber laminate (CFK) and aramide.

* * * * *

UNITED STATES PATENT AND TRADEMARK OFFICE

CERTIFICATE OF CORRECTION

PATENT NO. : 6,672,028 B2
DATED : January 6, 2004
INVENTOR(S) : Henninger

It is certified that error appears in the above-identified patent and that said Letters Patent is hereby corrected as shown below:

Column 4,
Line 17, please delete “aid”, and substitute therefore -- said --; and
Line 24, please delete “substantial y”, and substitute therefore -- substantially --.

Signed and Sealed this

Seventh Day of September, 2004

JON W. DUDAS
*Director of the United States Patent and Trademark Office*